US008484899B2

(12) United States Patent
Speyer et al.

(10) Patent No.: US 8,484,899 B2
(45) **Date of Patent: *Jul. 16, 2013**

(54) DRIVING AND DRIVEN SEALING SYSTEMS FOR SINGLE-HUNG DOOR/WINDOW

(75) Inventors: William Kip Speyer, Boca Raton, FL (US); Bryan D. Dervarics, Pompano Beach, FL (US); Don S. Salerno, Hollywood, FL (US)

(73) Assignee: Tyto Life LLC, Kent County, DE (US)

( * ) Notice: Subject to any disclaimer, the term of this patent is extended or adjusted under 35 U.S.C. 154(b) by 465 days.

This patent is subject to a terminal disclaimer.

(21) Appl. No.: 12/392,336

(22) Filed: Feb. 25, 2009

(65) Prior Publication Data

US 2010/0077665 A1 Apr. 1, 2010

Related U.S. Application Data

(60) Provisional application No. 61/101,549, filed on Sep. 30, 2008.

(51) Int. Cl.
*E06B 7/205* (2006.01)
*E06B 7/28* (2006.01)

(52) U.S. Cl.
USPC ..... 49/316; 49/317; 49/318; 49/319; 49/303; 49/304; 49/306

(58) Field of Classification Search
USPC ..... 49/303–306, 316–321, 276–278
See application file for complete search history.

(56) References Cited

U.S. PATENT DOCUMENTS 19,217 A 1/1858 Tinney
724,139 A 3/1903 Smith (Continued)

OTHER PUBLICATIONS

Dictionary.com, "Active," retrieved online at: http://dictionary.reference.com/browse/active (2010).

(Continued)

*Primary Examiner* — Katherine Mitchell
*Assistant Examiner* — Marcus Menezes
(74) *Attorney, Agent, or Firm* — Nelson Mullins Riley & Scarborough LLP; Anthony A. Laurentano

(57) ABSTRACT

A combination sealing system includes a driving sealing system, a driven sealing system, and a drive system. The driving sealing system includes a tongue attached to and extending away from a sash of a first panel, and a receiver attached to and within a frame. The driven sealing system includes a rotational member connected to a meeting rail of a second panel, and a first catch connected to a meeting rail of the first panel. The drive system is attached to the receiver and the rotational member. The first catch is configured to engage the rotational member. The receiver is configured to receive the tongue. The first panel is movable between an open position and a completely closed position. Prior to the first panel being in the completely closed position, the drive system transfer motion within the drive sealing system to the driven sealing system.

6 Claims, 5 Drawing Sheets

U.S. PATENT DOCUMENTS 946,305 A 1/1910 Twyman
982,828 A 1/1911 Kelly
1,009,978 A 11/1911 Knappe
1,021,862 A 4/1912 Culver
1,170,101 A 2/1916 Pullets
1,178,775 A 4/1916 Albright
1,345,967 A 7/1920 Smelser
1,468,958 A 9/1923 Champion
1,489,018 A 4/1924 Shultz
1,675,230 A 6/1928 Snyder
1,715,188 A 5/1929 Bullock
1,784,374 A * 12/1930 Miller ..... 49/277
1,797,839 A 3/1931 Ramsay
1,974,269 A 9/1934 Gonder
1,977,726 A 10/1934 Jacobson
1,995,939 A 3/1935 Osten
2,207,065 A 7/1940 McCormick
2,248,719 A 7/1941 Owen
2,268,114 A 12/1941 Foster
2,541,421 A 2/1951 Hunter
2,552,369 A 5/1951 Currie
2,593,093 A 4/1952 Bjork
2,628,678 A 2/1953 Webster
2,719,342 A 10/1955 Hunt
2,753,020 A 7/1956 Ware
2,766,860 A 10/1956 Travis
2,805,451 A 9/1957 Evans
2,837,151 A 6/1958 Stroup
2,862,256 A 12/1958 Stroup
2,862,262 A 12/1958 Shea
2,928,144 A 3/1960 Persson
3,004,309 A 10/1961 Karodi
3,054,152 A 9/1962 Trammell
3,059,287 A 10/1962 Baruch
3,070,856 A 1/1963 Minick
3,077,644 A 2/1963 Kesling
3,098,519 A 7/1963 Myers
3,111,727 A 11/1963 Gerecke
3,115,026 A * 12/1963 Moore ..... 70/135
3,126,051 A 3/1964 Sussin
3,163,891 A 1/1965 Seliger
3,184,806 A 5/1965 Bragman
3,204,999 A * 9/1965 Schwenk ..... 49/213
3,252,255 A 5/1966 Marpe
3,289,377 A 12/1966 Hetman
3,295,257 A 1/1967 Douglass
3,335,524 A 8/1967 Carson
3,374,821 A 3/1968 White
3,383,801 A 5/1968 Dallaire
3,440,762 A * 4/1969 Olsson ..... 49/209
3,466,801 A 9/1969 Bohn
3,512,303 A 5/1970 Wright
3,590,530 A 7/1971 Duguay
3,590,531 A 7/1971 Childs
3,660,936 A 5/1972 Bryson
3,660,940 A 5/1972 Tavano
3,816,966 A 6/1974 Sause, Jr.
3,818,636 A 6/1974 Calais et al.
3,821,884 A 7/1974 Walsh
3,848,908 A 11/1974 Rich
3,857,199 A 12/1974 Frach et al.
3,910,155 A 10/1975 Wilson
3,940,886 A * 3/1976 Ellingson, Jr. ..... 49/319
3,959,927 A 6/1976 Good
4,018,022 A 4/1977 Fink
4,027,431 A 6/1977 Rackard
4,064,651 A * 12/1977 Homs ..... 49/319
4,128,967 A 12/1978 Kirsch
4,170,846 A 10/1979 Dumenil et al.
4,307,542 A 12/1981 Lense
4,317,312 A 3/1982 Heideman
4,322,914 A 4/1982 McGaughey
4,392,329 A 7/1983 Suzuki
4,413,446 A 11/1983 Dittrich
4,453,346 A 6/1984 Powell et al.
4,479,330 A 10/1984 Muller
4,496,942 A 1/1985 Matsuoka
4,535,563 A 8/1985 Mesnel
4,614,060 A 9/1986 Dumenil et al.
4,656,779 A 4/1987 Fedeli
4,656,799 A 4/1987 Maryon
4,716,693 A 1/1988 Webster
4,765,105 A 8/1988 Tissington et al.
4,768,316 A 9/1988 Haas
4,831,509 A 5/1989 Jones et al.
4,837,560 A 6/1989 Newberry
4,870,909 A 10/1989 Richter
4,936,049 A 6/1990 Hansen
5,007,202 A 4/1991 Guillon
5,020,292 A 6/1991 Strom et al.
5,029,911 A 7/1991 Daniels
5,030,488 A 7/1991 Sobolev
5,187,867 A 2/1993 Rawlings
5,293,726 A 3/1994 Schick
5,327,684 A 7/1994 Herbst
5,339,881 A 8/1994 Owens
5,349,782 A 9/1994 Yulkowski
5,379,518 A 1/1995 Hopper
5,446,997 A 9/1995 Simonton
5,467,559 A 11/1995 Owens
5,479,151 A 12/1995 Lavelle et al.
5,511,833 A 4/1996 Tashman et al.
5,521,585 A 5/1996 Hamilton
5,522,180 A 6/1996 Adler et al.
5,522,195 A 6/1996 Bargen
5,569,878 A 10/1996 Zielinski
5,584,142 A 12/1996 Spiess
5,605,013 A 2/1997 Hogston
5,638,639 A 6/1997 Goodman et al.
5,784,834 A 7/1998 Stutzman
5,786,547 A 7/1998 Zielinski
5,870,859 A 2/1999 Kitada
5,870,869 A 2/1999 Schrader
5,964,060 A 10/1999 Furlong
6,041,552 A 3/2000 Lindahl
6,057,658 A 5/2000 Kovach et al.
6,082,047 A 7/2000 Comaglio et al.
6,105,313 A 8/2000 Holloway et al.
6,112,466 A 9/2000 Smith et al.
6,112,467 A 9/2000 Bark et al.
6,112,496 A 9/2000 Hugus et al.
6,170,195 B1 1/2001 Lim
6,173,533 B1 1/2001 Cittadini et al.
6,181,089 B1 1/2001 Kovach et al.
6,202,353 B1 3/2001 Giacomelli
6,218,939 B1 4/2001 Peper
6,243,999 B1 6/2001 Silverman
6,289,643 B1 9/2001 Bonar
6,293,049 B1 * 9/2001 Shaw ..... 49/183
6,318,037 B1 11/2001 Hansen
6,442,899 B1 9/2002 Gledhill
6,490,832 B1 12/2002 Fischbach et al.
D470,252 S 2/2003 Castrey
6,546,682 B1 4/2003 DeBlock et al.
6,553,735 B1 4/2003 Wang Chen
6,568,131 B1 5/2003 Milano, Jr.
6,619,005 B1 9/2003 Chen
6,644,884 B2 11/2003 Gledhill
6,651,389 B2 11/2003 Minter et al.
6,772,818 B2 8/2004 Whitley et al.
6,786,005 B1 9/2004 Williams
6,871,902 B2 3/2005 Carson et al.
6,973,753 B2 12/2005 Liebscher
7,010,888 B2 3/2006 Tumlin et al.
7,124,538 B1 10/2006 Kline
7,145,436 B2 12/2006 Ichikawa et al.
7,185,468 B2 3/2007 Clark et al.
7,487,616 B2 2/2009 Deaver
7,566,035 B2 7/2009 Bonshor
7,624,539 B2 12/2009 Speyer et al.
7,627,987 B2 12/2009 Thielmann et al.

| | | | | |
|---|---|---|---|---|
| 7,665,245 | B2 | 2/2010 | Speyer et al. | |
| 7,685,774 | B2 | 3/2010 | Thielmann | |
| 7,685,775 | B2 | 3/2010 | Speyer et al. | |
| 7,685,776 | B2 | 3/2010 | Speyer et al. | |
| 7,707,773 | B2 * | 5/2010 | Thielmann et al. | 49/321 |
| 7,719,213 | B2 | 5/2010 | Herman et al. | |
| 2003/0033786 | A1 | 2/2003 | Yulkowski | |
| 2004/0068935 | A1 | 4/2004 | Ichikawa et al. | |
| 2005/0097842 | A1 | 5/2005 | Arcamonte et al. | |
| 2005/0102908 | A1 | 5/2005 | Martin | |
| 2006/0207199 | A1 | 9/2006 | Darnell | |
| 2007/0289221 | A1 | 12/2007 | Speyer et al. | |
| 2009/0151259 | A1 | 6/2009 | Speyer et al. | |
| 2009/0165415 | A1 | 7/2009 | Salerno | |
| 2009/0165423 | A1 | 7/2009 | Salerno | |
| 2010/0077665 | A1 | 4/2010 | Speyer et al. | |

OTHER PUBLICATIONS

Patio Life—Operation, retrieved online at: http://www.rotohardware.com/Products/Patio%20Life/PL-Operation.htm (2006).

International Search Report for Application No. PCT/US2010/029383, dated May 25, 2010.

International Search Report for Application No. PCT/US2010/029206, dated Jun. 2, 2010.

* cited by examiner

DRIVING AND DRIVEN SEALING SYSTEMS FOR SINGLE-HUNG DOOR/WINDOW

CROSS-REFERENCE TO RELATED APPLICATIONS

This application claims the benefit of U.S. Provisional Application No. 61/101,549 filed Sep. 30, 2008, which is incorporated herein by reference in its entirety. This application is related to U.S. patent application Ser. No. 12/392,326 filed Feb. 25, 2009 and entitled "SELF-DRIVING COMBINATION SEALING SYSTEM FOR SINGLE-HUNG DOOR/WINDOW," which is incorporated herein by reference in its entirety.

BACKGROUND OF THE INVENTION

1. Field of the Invention

The disclosure relates generally to sealing systems for use with panels, such as a door or a window, within a frame and, more specifically, to a self-driving combination sealing system for providing an improved seal between a panel and frame.

2. Description of the Related Art

Certain types of panels, such as doors and windows, are positioned within openings of a wall and/or other structures using a frame. These panels may also open and close by pivoting relative to the frame. Alternatively, the one or more panel may slide relative to the frame. An issue associated with these types of panels is the integrity of the seals between the panels and the frame. In many instances, these seals are an insufficient barrier in preventing the transfer of such environmental elements as noise, weather, water, and insects from one side of the panel to the other side of the panel.

Attempts have been made to address these issues by using various types of weather stripping between the panels and frame. For example, the weather stripping may be strip of felt, foam, or a pile of flexible synthetic material. In many instances, however, this weather stripping fails to act as a sufficient seal between the panels and frame. Another issue prevalent associated with the seals between a frame and panel or between adjacent panels is that these seals can become disjoined. Either intentionally or unintentionally, the alignment between the frame and panel or between adjacent panels may be disturbed which can degrade the quality of the seal since, in many instances, the integrity of the seal relies upon these members having certain positional relationships relative to one another.

Another issue associated with the movement of one or more panels relative to the frame is structural integrity and/or security of the panels relative to the frame. While in certain circumstances, allowing the panel to move relative to the frame is desirable, in other circumstances, not allowing the panel to move relative to the frame is desirable for the purpose of preventing undesired access through the panel. Features for providing these separate functionalities, however, can be incompatible with one another, and the features employed to provide both functions often involve tradeoffs that reduce the effectiveness of both functions.

There is, therefore, also a need for a sealing system that effectively allows both a panel to move relative to the frame and also to selectively prevent movement of the panel relative to the frame. There is also a need for a sealing system that can be employed between a frame and panel that prevents the transfer from one side of the panel to the other side of the panel such environmental effects as noise, weather, water, heat/cold, and insects.

BRIEF SUMMARY OF THE INVENTION

Embodiments of the invention address deficiencies of the art with respect to effectively creating a seal between a panel and a frame. For example, a combination sealing system includes a driving sealing system, a driven sealing system, and a drive system. The driving sealing system includes a tongue attached to and extending away from a sash of a first panel, and a receiver attached to and within a frame. The driven sealing system includes a rotational member connected to a meeting rail of a second panel, and a first catch connected to a meeting rail of the first panel. The drive system is attached to the receiver and the rotational member. The first catch is configured to engage the rotational member. The receiver is configured to receive the tongue. The first panel is movable between an open position and a completely closed position. Prior to the first panel being in the completely closed position, the drive system transfers motion within the drive sealing system to the driven sealing system. Additionally, the frame, the first panel, and the second panel are within a single-hung window.

In certain aspects of the combination sealing system, prior to the first panel being in the completely closed position, the receiver receives the tongue and the motion of the receiver is transferred to the driven sealing system. In the completely closed position of the first panel, the tongue extends into the frame. The receiver includes a first arm, the tongue includes a head, and engagement of the head with the first arm causes rotation of the receiver. The receiver also includes a second arm, and in the completely closed position of the first panel, the second arm prevents removal of the tongue from within the frame. A lock is also included that prevents the receiver from rotating.

In additional aspects of the combination sealing system, the rotational member includes a rotational stop, and in the completely closed position of the first panel, the rotational member prevents movement of the first panel out of the completely closed position. A stationary stop is connected to the meeting rail of the second panel, and a second catch connected to the meeting rail of the first panel. The stationary stop is configured to engage the second catch Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
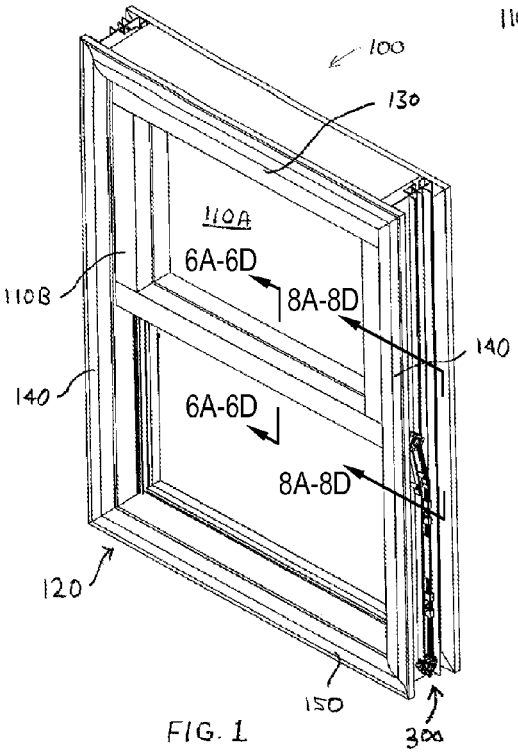
FIG. 1 is a perspective view of a door/window system in an open position in accordance with the inventive arrangements.

FIGS. 1-4 illustrate an exemplar door/window system 100 for use with an improved sealing system 200 and combination of sealing systems 200. The sealing system 200 can be used with many types of doors and/or windows, and the sealing system 200 is not limited to the particular door/window system 100 illustrated. For example, the sealing system 200 may be used with pocket doors, sliding doors, French doors, entry doors, garage doors, sliding windows, single-hung windows, double-hung windows, casement windows, and awning windows. The door/window system 100 includes at least one panel 110A, 110B connected to and movable relative to a stationary frame 120.

The door/window system 100 is not limited in the manner in which the panel 110A, 110B moves relative to the frame 120. For example, the panels 110A, 110B may pivot relative to the frame 120. In certain aspects of the door/window system 100, however, either one or both of the panels 110A, 110B may move relative to the frame 120 along a plane parallel to a longitudinal axis of one of the surfaces (e.g., the header 130, jambs 140, or sill 150) of the frame 120 and/or substantially along a plane defined by the panel 110A, 110B. In still further aspects of the door/window system 100, one or more of the panels 110A, 110B can move relative to the frame 120 in multiple manners (e.g., pivoting relative to the frame 120 and sliding relative to the frame 120). In certain aspects of the door/window system 100, one panel 110A is movable relative to the frame 120 and one panel 110B is fixed relative to the frame. An example of this type of configuration is a single-hung window.

The frame 120 may include a header 130, jambs 140, and a sill 150. A header 130 is a structural member that spans an upper portion of the window/door opening. Jambs 140 are the outermost vertical side members of the frame 120. A sill 150 is a threshold or structural member that spans a lower-most portion of the window/door opening. As recognized by those skilled in the art, different terms may also be associated with the above-structure identified as the header 130, jambs 140, and sill 150.

Each panel 110 may include a sash 160 that surrounds a pane 170. The pane 170 is not limited as to a particular material. For example, the pane 170 may be translucent, such as glass or plastic, opaque, such as with wood or metal, or any combination thereof. The sash may include a header rail 175, jamb or stile rails 180, and a sill rail 185. As recognized by those skilled in the art, different terms may also be associated with the structure identified as the header rail 175, the jamb or stile rail 180, and sill rail 185. The respective rails of the panels 110A, 110B that adjoin one another when the door/window system 100 is closed are also known as meeting rails 190A, 190B.

The sealing system 200 (see FIGS. 5A-5C, 6A-6D, 7A-7D, 8A-8D) may be used with each of the members 175, 180, 185, 190 of the sash 160 to form a seal between each pair of adjacent surfaces of the sash 160 of the panel and the frame 120 or between adjacent surfaces of the meeting rail 190A of one panel 110A and the meeting rail 190B of another panel 110B. In this manner each of the separate sides of the panels 110A, 110B may employ the sealing system 200. As will be described in more detail below, not only does the sealing system 200 provide at least one seal between adjacent members of sash 160 and frame 120 or between adjacent meeting rails 190A, 190B, each of the sealing systems 200 may be configured to prevent movement of the panels 110A, 110B relative to the frame 120. In so doing, the sealing systems 200 can act as a lock and/or security device that prevents the forced opening of the panels 110A, 110B relative to the frame 120. Many types of sealing systems 200 so capable are known in the art, and the present door/window system 100 is not limited as to a particular type of sealing system 200. In addition, the present door/window system 100 may employ one or more different types of sealing systems 200.

Additionally, although the present door/window system 100 is described herein with particular types of sealing systems 200 being positioned in particular locations, the door/window system 100 is not limited as to a particular type of sealing system 200 or a particular location of the sealing system 200. For example, a sealing system 200 may be positioned within the frame 120 and/or the sash 160.

To prevent the forced opening of the panels 110A, 110B, the sealing systems 200 are not limited as to a percentage of coverage between particular members of the frame 120 and/or panels 110A, 110B. For example, the sealing systems 200 may only cover a fractional number (e.g., 10%, 50%, 85%) of the length between particular members of the frame 120 and/or panels 110A, 110B. However, in certain aspects, the sealing systems 200 provide substantially complete coverage between the sash 160 of a panel 110A, 110B and the frame 120 or between the meeting rail 190A of one panel 110A and the meeting rail 190B of another panel 110B. In so doing, the combined sealing systems 200 are capable of providing a seal substantially completely around one or both of the panels 110A, 110B.

Although not limited in this manner, some or all of the sealing systems 200A, 200B, 200C may be self-driving. As the term is used herein, a self-driving combination sealing system is one in which the movement of one of the panels 110A relative to the frame 120 towards a closed position causes the engagement of one of the sealing systems 200A, and the motive force created by the engagement of one of the sealing systems 200A drives the engagement of one or more of the other sealing systems 200B, 200C positioned along other sides of the panel 110A.

Bottom Sealing System

Referring to FIGS. 5A and 6A-6D, one configuration of a sealing system 200A for use in the door/window system 100 is illustrated. As illustrated, the panel 110A begins in an open position (e.g., FIG. 6A) and transitions (e.g., FIGS. 6B-6C) into a complete closed position (e.g., FIG. 6D). As the panel 110A is positioned from the open position and prior to being in the completely closed position, a portion of the panel 110A engages a portion of the frame 120. In engaging the frame 120, the portion of the panel 110A is capable of causing movement of a first movable member 235 within the frame 120. Although the first movable member 235 is not limited as to a particular type of member or how the member moves, in certain aspects of the door/window system 100, the first movable member 235 is a shaft or spindle that rotates when the portion of the panel 110A engages the frame 120.

Figure 6A:
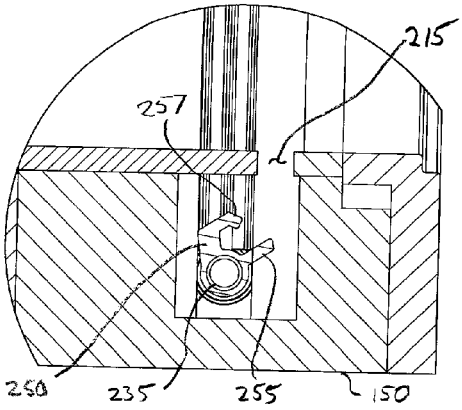
FIGS. 6A-6D are cross-sectional views of a sealing system positioned in a sill and sash of the door/window system, respectively, in the open, closed and unlocked, closed and partially locked, and closed and locked configurations, in accordance with the inventive arrangements.
Figure 6B:
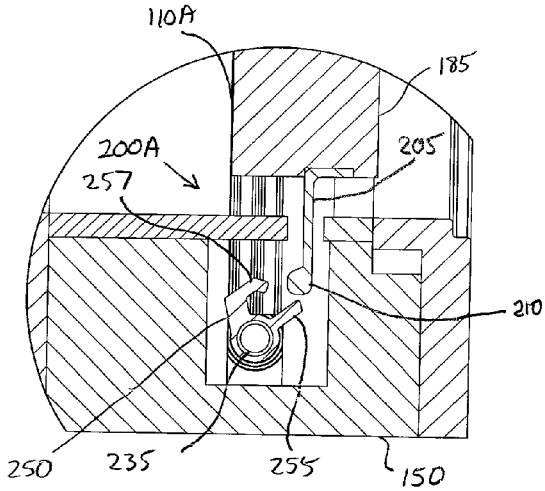
Figure 6C:
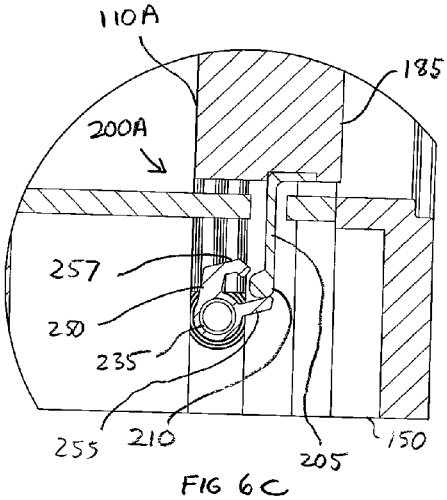

The door/window system 100 is not limited in how the portion of the panel 110A engages the portion of the frame 110. However, in certain aspects, a tongue 205 extends from a sill rail 185 of the panel 110A. Referring to FIG. 6B, upon the sill rail 185 approaching the sill 150 of the frame 120, the tongue 205 may pass through a slot 215 within the frame 120, and in FIG. 6C, a head 210 of the tongue 205 engages a first arm 255 of a receiver 250. The receiver 250 is positioned within the frame 120, and engagement of the receiver 250 by the tongue causes rotation of the receiver 250, which results into rotational movement of the first movable member 235.

Figure 6D:
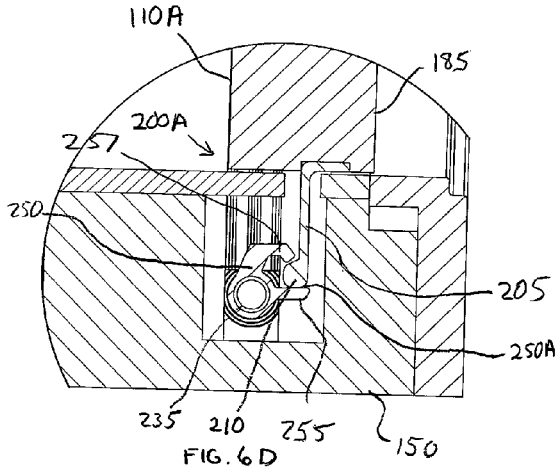
Figures 7A, 7B, 7C, 7D:
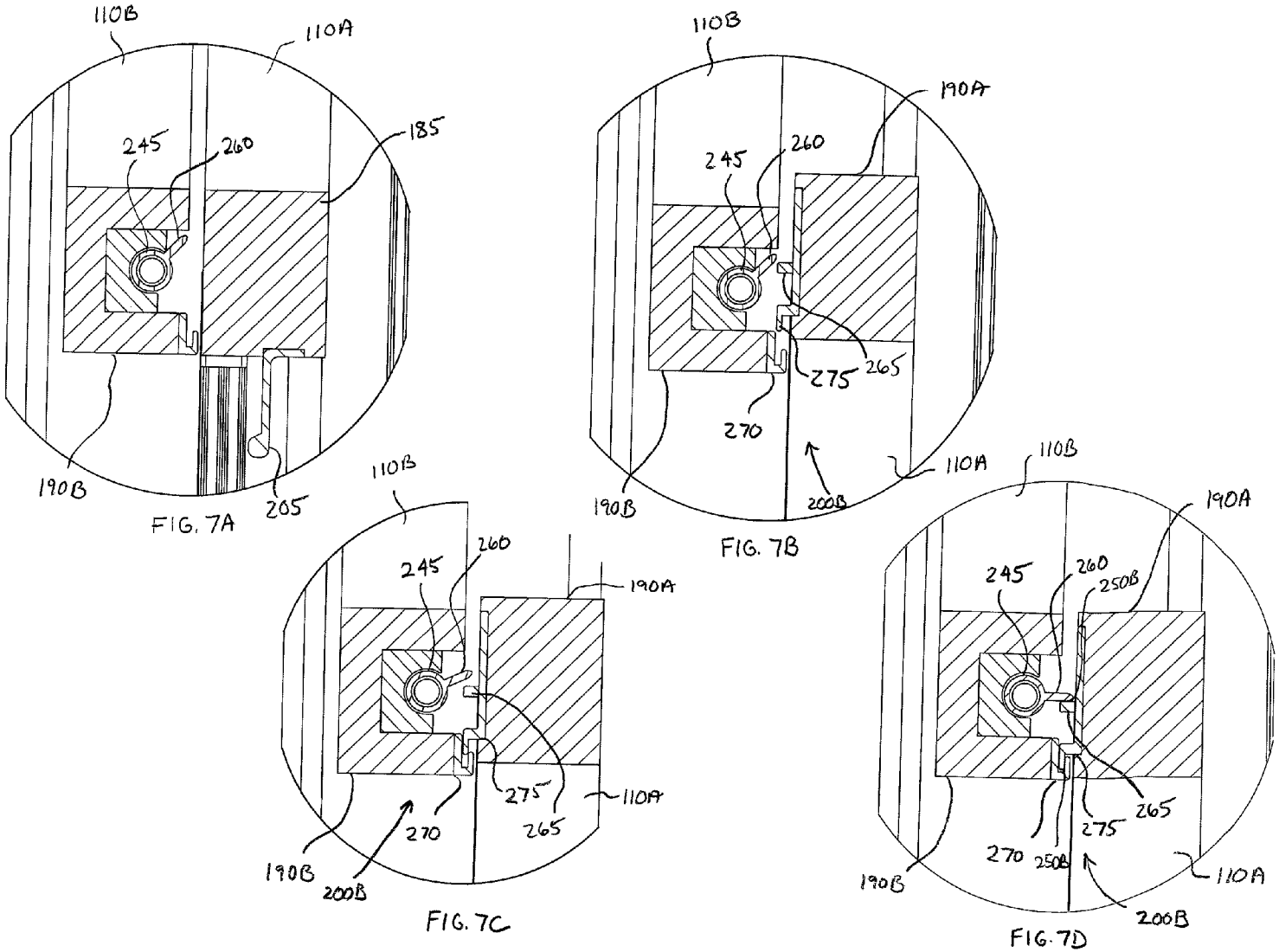
FIGS. 7A-7D are cross-sectional views of a sealing system positioned in meeting rails of the door/window system, respectively, in the open, closed and unlocked, closed and partially locked, and closed and locked configurations, in accordance with the inventive arrangements.
Figure 8A:
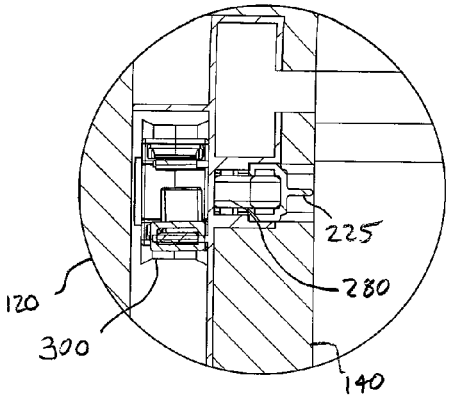
FIGS. 8A-8D are cross-sectional views of a sealing system positioned in a jamb and sash of the door/window system, respectively, in the open, closed and unlocked, closed and partially locked, and closed and locked configurations, in accordance with the inventive arrangements.
Figure 8B:
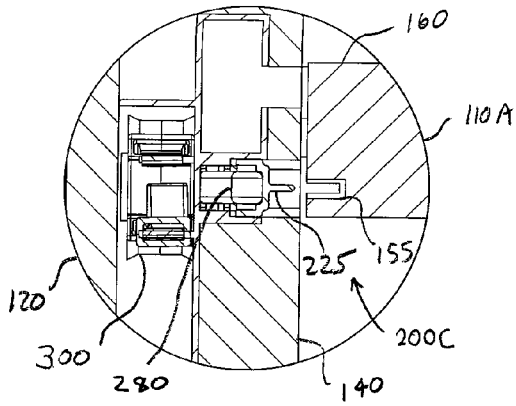
Figure 8C:
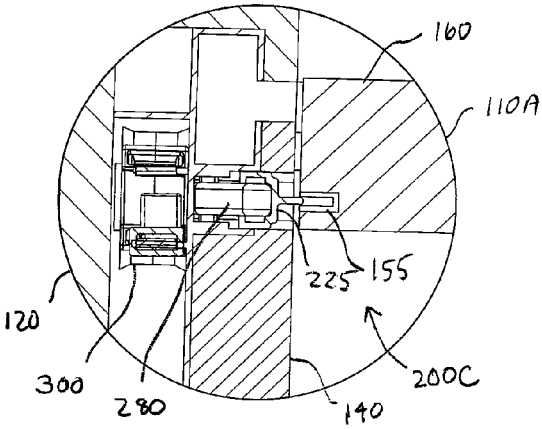
Figure 8D:
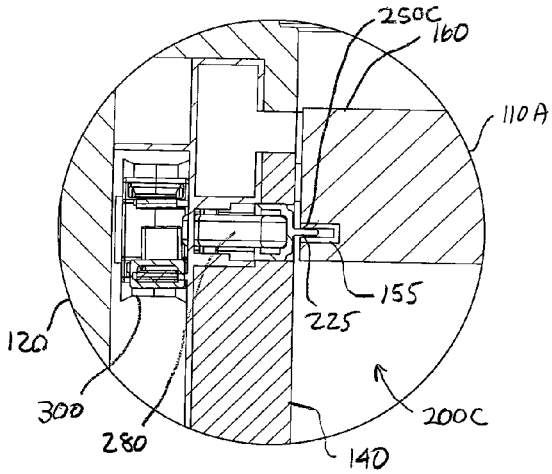

Although not limited in this manner, the receiver may include a second arm 257. In FIG. 6D, upon the panel 110A being fully closed, the second arm 257 extends in a manner so as to prevent the tongue 205 from being withdrawn from the slot 215 upon the receiver being prevented from rotating. Although many possible configuration of the second arm 257 are so capable, in certain aspects of the receiver 250, the second arm 257 extends above the head 210 of the tongue 205 upon the tongue 205 fully engaging the receiver 250.

As will be described in further detail below, when a lock 400 is engaged, the receiver 250 is kept from rotating, which prevents the tongue 205 from being withdrawn from the slot 215. In this manner, the panel 110A is held in place relative to the frame 120. Although not illustrated, passive seals may be positioned between a bottom of the sill rail 185 and the top of the sill 150. The engagement of the passive seals with either the sill rail 185 or sill 150 and/or the aforementioned engagement of the portion of the panel 110A with the portion of the frame 120 may create a seal 250A therebetween.

Top Sealing System

Referring to FIGS. 5B and 7A-7D, another configuration of a sealing system 200B for use in the door/window system 100 is illustrated. The sealing system 200B includes a rotational stop 260 that is driven by a second rotational member 245 to engage a first catch 265. In certain aspects of the sealing system 200B, the rotational stop 260 is positioned within the meeting rail 190B of the second panel 110B, and the first catch 265 is positioned on the meeting rail 190A of the first panel 110A.

Although not necessarily present, certain embodiments of the door/window system 100 includes a stationary stop 270 and second catch 275, which mate together to form a seal between the first panel 110A and the second panel 110B. The engagement of the stationary stop 270 and the second catch 275 and/or the engagement of the rotation stop 260 and the first catch 265 may create a seal 250B therebetween.

The combination stationary stop 270 and second catch 275 may also act to limit the range of movement, in at least one direction, of the first panel 110A within the frame 120. In certain aspects, whereas the combination of the stationary stop 270 and second catch 275 act to limit the movement, in one direction, of the first panel 110A relative to the second panel 110B, the combination of the rotation step 260 and first catch 265 act to limit the movement, in a second direction, substantially opposite the first direction, of the first panel 110A relative to the second panel 110B. In this manner, the movement of the first panel 110A within the frame 120 can be restricted.

Side Sealing System

Referring to FIGS. 8A-8D, another configuration of a sealing system 200C for use in the door/window system 100 is illustrated. As the panel 110A is being positioned within the closed position (e.g., FIGS. 8B-8D), the sealing system 200C also includes a movable member 225 that is driven by a drive system 300 from a first, unlocked position to a second, locked position to form a seal 250C between, for example, adjacent members of sash 160 and the jamb 140 of the frame 120. Although not limited in this manner, in certain aspects, the movable member 225 is driven to move along a single plane substantially parallel to a plane defined by the panel 110.

In certain aspects of the sealing system 200, the seal 250C is formed by engagement of the movable member 225 positioned on one of the frame 120 and sash 160 with another feature positioned on the other of the frame 120 and sash 160. However, in certain aspects of the sealing system 200, the movable member 225 is disposed in the frame 120 and engages a portion of the sash 160 of the panel 110A.

Although not limited in this manner, the sealing system 200C may be positioned within a jamb 140 of the frame 120, and the movable member 225 is variably extendable through the jamb 140. Upon being extended, the movable member 225 may engage an inner surface of a channel 155 within the sash 160 to form a seal 250C between the movable member 225 and the sash 160.

Seal Drive System

Referring to FIGS. 4, 5B-5C, 8A-8D, a drive system 300 for use in the door/window system 100 is illustrated. The drive system 300 moves the sealing systems 200 from the unlocked configuration (e.g., FIGS. 6A-6C, 7A-7C) to a locked configuration (e.g., FIGS. 6D, 7D). The drive system 300 may also move the sealing system 200 from the locked configuration to the unlocked configuration. In certain aspects, the drive systems 300 are configured to simultaneously move each of the separate sealing systems 200 (e.g., sealing systems 200B, 200C). In other aspects of the door/window system 100, however, multiple drive systems 300 may be provided to separately close one or multiple sealing systems 200.

How the drive system 300 moves a particular sealing system 200 from the unlocked configuration to the locked configuration (and back again) is not limited as to a particular manner and/or device. As can be readily envisioned, the configuration and operation of the drive system 300 may be determined by the configuration and operation of the sealing systems 200.

The illustrated drive system 300 is shown as being manually driven. However, other devices capable of driving a sealing system 200 are commonly known, such as a pneumatic, hydraulic, magnetic, mechanical, and electro-mechanical devices. A combination of these devices may also be used. In certain aspects of the door/window system 100, the drive system 300 is manually driven via the closing of the panel 110A. As previously discussed with regard to FIGS. 6A-6D, engagement of the panel 110A with the sealing system 200A generates movement within the first rotational member 235. This movement is transferred, from the first rotation member 235, to the drive system 300, via the first transfer system 230. In so doing the sealing system 200A acts as a combination sealing/drive system.

The sealing systems 200 within the jambs 140 and sill 150 are not limited in the manner in which the respective movable members 225 are driven from the first position to the second position and back again. Many types of drive systems 300 are known that are capable of transferring movement from one member to another member and the sealing system 200 is not limited in a device so capable. However, in certain aspects of the sealing system 200, the movement of the movable member 225 is driven by a drive system 300 that transfers back and forth motion of an actuator 220 that extends along a length of the sealing system 200.

A transfer device transfers the back and forth motion of the actuator 220 to the movable member 225 thereby moving the movable member 225 from the disengaged/unlocked position to the engaged/locked position and back again. Many types of devices are capable of transferring motion along one direction to another direction, and the transfer device is not limited to any type of device so capable. However, in certain aspects of the drive system 300 and referring to FIG. 5C, the transfer device is a rocker 280 that is pivotally connected to the actuator 220, the movable member 226 and the jamb 140. As the actuator 220 moves back and forth, the rocker 280 pivots about a pivot on the jamb 140 and moves the movable member 225 between the disengaged/unlocked position and the engaged/locked position.

Referring to FIGS. 5B and 7A-7D and as previously described, one of the sealing systems 200 operates using a rotation stop 260, which engages a first catch 265 to form a seal between the meeting rails 190A, 190B. Any drive system 300 capable of driving rotational stop 260 in this manner is acceptable for use with the present door/window system 100. In a present aspect of the door/window system 100, the rotational stop 260 is connected to the first rotational member 245, and the second rotational member 245 is connected, either directly or indirectly, to other drive members of the drive system 300. For example, the second rotational member 245 may be connected to a second transfer system 240, such as a pulley or sprocket, which is connected to the actuator. As the actuator 220 is moved in one direction or a reverse direction, the rotational stop 260 either rotates to engage or disengage the first catch 265

Although not limited in this manner, in certain aspects, the actuator 220 is a belt that connects the first transfer system 230 to the second transfer system 240. The drive system 300 may also include guides 310 that redirect the orientation of the belt 220. For example, the first transfer system 230 may rotate about an axis within a plane substantially defined by panel 110A, and the second transfer system 240 may rotate about an axis within a plane substantially defined by panel 110B, and these planes can be offset from one another. Use of the guides 310 permit the belt 220 to follow along the plane substantially defined by panel 110A along a substantial length of panel 110A while being subsequently diverted, by the guides 310, to the plane defined by panel 110B as the belt 220 nears the second transfer system 240.

Lock

Figure 2:
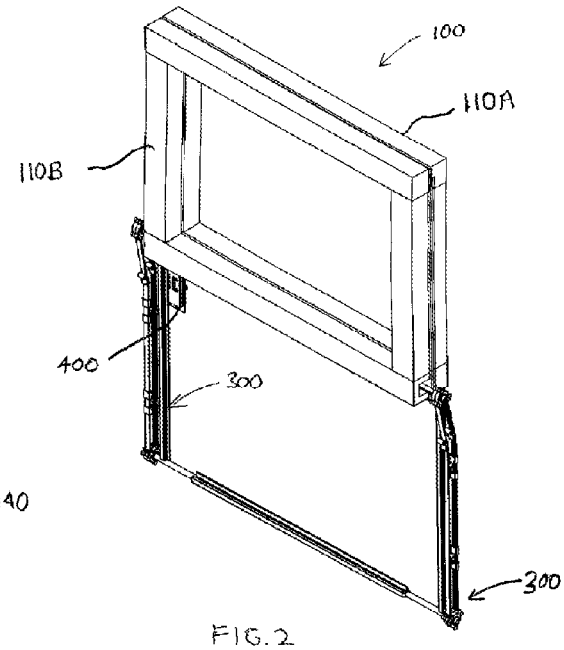
FIG. 2 is a partial perspective view of a door/window system in an open position and showing portions of drive and sealing systems in accordance with the inventive arrangements.
Figure 3:
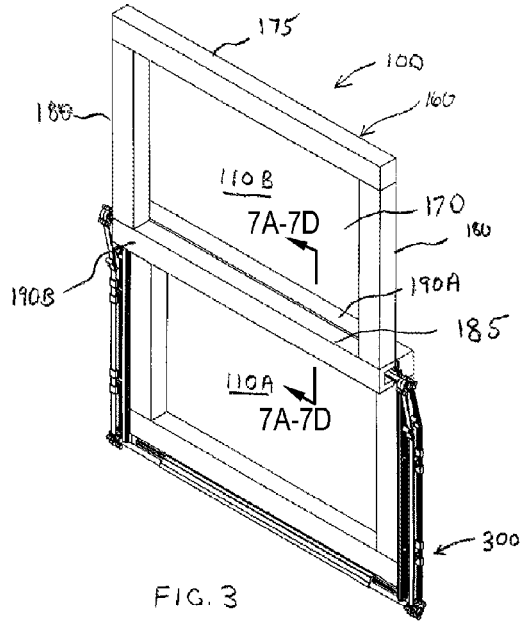
FIG. 3 is a partial perspective view of a door/window system in an closed position and showing portions of the drive and sealing systems in accordance with the inventive arrangements.
Figure 5B:
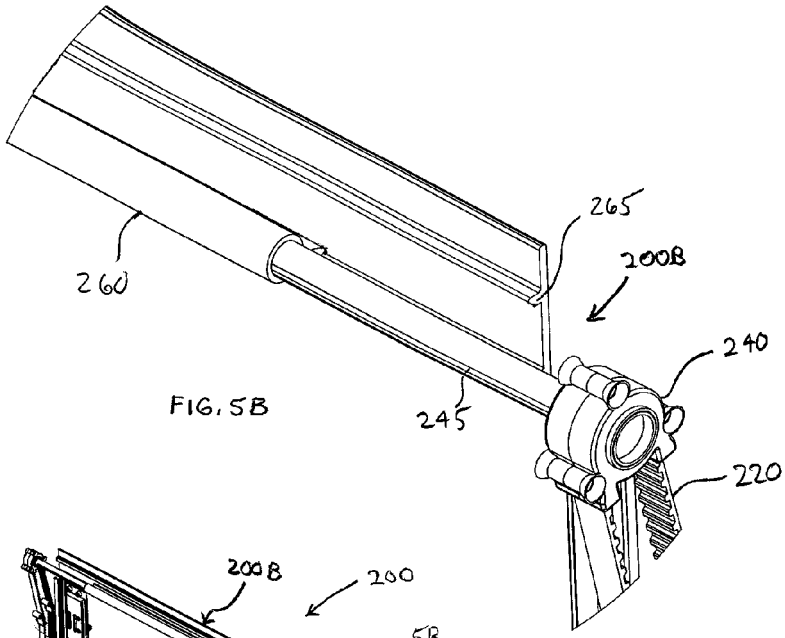
FIGS. 5A-5C are enlarged perspective views, respectively, of views 5A, 5B, and 5C illustrated in FIG. 4.
Figure 4:
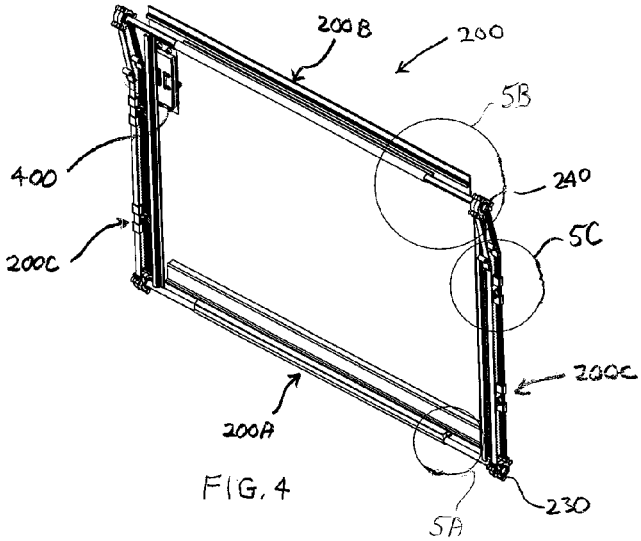
FIG. 4 is a partial perspective view of the drive and sealing systems in accordance with the inventive arrangements.
Figure 5A:
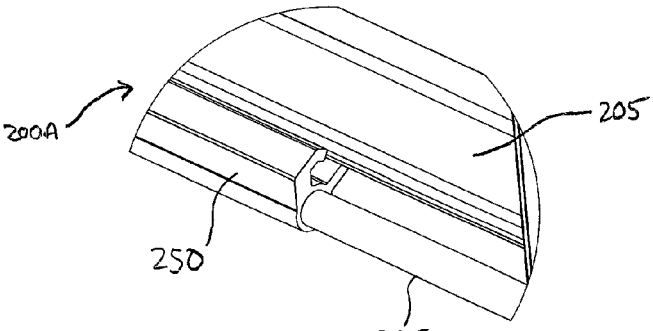
Figure 5C:
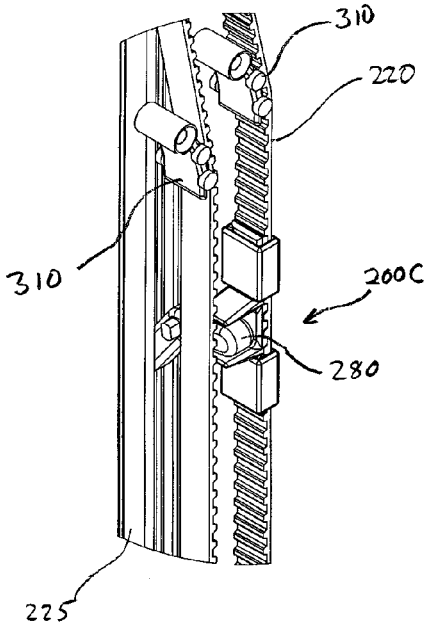

Referring to FIG. 2, the door/window system 100 may also include a lock 400. Upon being activated, the lock 400 acts to prevent movement of the panel 110A within the frame 120 after the sealing systems 200A, 200B, 200C. The door/window system 100 is not limited as to a particular lock 400 so capable. In certain aspects of the door/window system 100, however, the lock 400 directly arrests movement of the actuator 220 thereby preventing the sealing systems 200A, 200B, 200C from disengaging. Since one or more of the sealing systems 200A, 200B, 200B prevents movement of the panel 110A within the frame 120, arresting movement of the actuator 220 also prevents movement of the panel 110A within the frame 120.

The lock 400 is not limited as to a particular manner in which the movement of the actuator 220 is directly arrested, as one skilled in the art would recognize that a multitude of different mechanisms could be employed. For example, the lock 400 could employ a clamp (not shown) around that actuator 220. Alternatively, the lock 400 could insert a pin (not shown) into a hole within the actuator 220.

What is claimed is:

1. A driving sealing system for use with a frame and a first panel having a sash, comprising:
- a tongue attached to a sill of the sash and extending away from the sill of the sash toward the frame; and
- a receiver attached to and entirely provided within the frame, wherein
- the receiver includes a moveable first arm and a second arm,
- wherein in a completely closed position of the first panel, the tongue extends into the frame and the second arm prevents removal of the tongue from within the frame,
- the receiver is configured to be attached to a drive system connected to a driven sealing system,
- the first arm of the receiver is configured to receive the tongue,
- receiving, by the first arm of the receiver, of the tongue causes the receiver and the first arm of the receiver to move, and
- motion of the receiver is transferred, by the drive system, to the driven sealing system.

2. The driving sealing system of claim 1, wherein
- the first panel is movable, relative to the frame, between at least an open position and a completely closed position,
- prior to the first panel being in the completely closed position, the receiver receiving the tongue and the motion of the receiver being transferred to the driven sealing system.

3. The driving sealing system of claim 1, wherein
- the tongue includes a head, and
- engagement of the head with the first arm causes rotation of the receiver.

4. The driving sealing system of claim 1, wherein
- the motion of the receiver is rotational.

5. The driving sealing system of claim 1, further comprising
- a lock, wherein the lock prevents the receiver from rotating.

6. The driving sealing system of claim 1, wherein
- the frame and the first panel are within a single-hung window.

* * * * *